United States Patent [19]

Takishima

[11] 4,167,836

[45] Sep. 18, 1979

[54] PROFILE GRINDING MACHINE

[75] Inventor: Tadao Takishima, Iruma, Japan

[73] Assignee: Citizen Watch Co., Ltd., Tokyo, Japan

[21] Appl. No.: 908,660

[22] Filed: May 23, 1978

[30] Foreign Application Priority Data

May 24, 1977 [JP] Japan ..... 52-60637

[51] Int. Cl.[2] ..... B24B 7/02

[52] U.S. Cl. ..... 51/124 R; 51/127

[58] Field of Search ..... 51/94 R, 97 NC, 101 R, 51/101 LG, 124 R, 124 L, 127

[56] References Cited

U.S. PATENT DOCUMENTS

| | | | |
|---|---|---|---|
| 3,041,789 | 7/1962 | Cretin-Maitenaz | 51/101 R |
| 3,119,206 | 1/1964 | Baumgartner | 51/101 LG |
| 3,834,085 | 9/1974 | Moeller | 51/101 R X |
| 3,943,664 | 3/1976 | Broide et al. | 51/101 R X |
| 3,973,360 | 8/1976 | Crevoiser | 51/127 X |

*Primary Examiner*—Gary L. Smith
*Assistant Examiner*—Robert P. Olszewski
*Attorney, Agent, or Firm*—Bernard & Brown

[57] ABSTRACT

A profile grinding machine for grinding the contour surface of an article to be ground such as a wrist watch case or the like is disclosed. The machine comprises a work shaft provided at its one end with a chuck for supporting the wrist watch case to be engaged with a grinder and a profile cam shaft provided at its one end with a profiling cam to be engaged with a profiling cam follower and at another end with a head swing control cam engaged with a cam follower roller. Both the work shaft and the profile cam shaft are rotatably supported by a head swing supporting shaft provided on a profile slide and driven in synchronism with each other. The profile slide is biased in a direction toward the profiling cam follower so as to urge the profiling cam against the profiling cam follower.

7 Claims, 6 Drawing Figures

PROFILE GRINDING MACHINE

BACKGROUND OF THE INVENTION

1. Field of the Invention

This invention relates to a profile grinding machine for grinding the contour surface of an article to be ground such as a wrist watch case or the like.

2. Description of the Prior Art

In the case of grinding an article to be ground such as a wrist watch case or the like, it has been required to grind the wrist watch case into such complex configuration that its continuous upper peripheral edge surface is inclined at different angles with respect to the horizontal plane of the wrist watch case so as to form a so-called distorted surface. In the conventional operation of grinding such distorted surface, it has heretofore been the common practice to effect a manual grinding operation by a skilled person for a considerably long time. In addition, the wrist watch cases thus ground were irregular and nonuniform in configuration and quality.

SUMMARY OF THE INVENTION

An object of the invention, therefore, is to provide a profile grinding machine for grinding the contour surface of an article to be ground such as a wrist watch case or the like which can eliminate the above mentioned drawbacks which have been encountered with the prior art techniques, that is, which makes use of a profiling cam and an inclined angle control cam or the like, these cams being suitably arranged such that the article can automatically be ground in a highly precise and efficient manner.

A feature of the invention is to provide a profile grinding machine for grinding the contour surface of an article to be ground such as a wrist watch case or the like, comprising a main body secured to a foundation, a work table reciprocally mounted on the main body, a profile slide slidably mounted on the work table and biased in a direction in parallel with the forward movement of the work table, a profile cam shaft having an axis provided in the profile slide and extending in parallel with the movable direction of the work table, a work shaft provided at its one end with a chuck for supporting an article to be ground and adapted to be rotated through a transmission mechanism in synchronism with the profile cam shaft, a head swing supporting shaft mechanism common to both the profile cam shaft and the work shaft and imparting the head swing movement of the profile cam shaft to the work shaft in synchronism with the profile cam shaft, a cam mechanism secured to the profile cam shaft provided in the profile slide and for controlling the head swing angle of the head swing, supporting shaft mechanism, and a grinding tool rotatably mounted on the main body and opposed to the chuck secured to the work shaft.

BRIEF DESCRIPTION OF THE DRAWINGS

The invention will now be described in greater detail with reference to the accompanying drawings, wherein.

DETAILED DESCRIPTION OF THE PREFERRED EMBODIMENT

Figure 1:
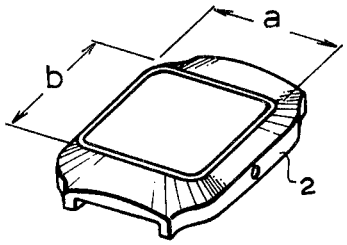
FIG. 1 is a perspective view of a wrist watch case to be used as an article to be ground by a profile grinding machine according to the invention.

Referring to the drawings, reference numeral 1 designates a grinding tool such as a grindstone or the like rotatably mounted on a main body 25 and adapted to be driven by a motor (not shown); 2 a wrist watch case as one example of an article to be ground, the wrist watch case 2 being secured through a chuck 3 to one end of a work shaft 4; 5 a movable supporting member for rotatably supporting the work shaft 4 and a profile cam shaft 8; 6 a head swing supporting shaft provided in a holder 7 projected from the profile slide 23 and imparting the head swinging movement to the work shaft 4; and 9 a profiling cam secured to the profile cam shaft 8.

Figure 2:
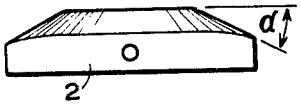
FIG. 2 is its front elevational view.
Figure 3:
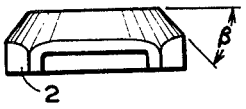
FIG. 3 is its side elevational view.

The profile of the profiling cam 9 must be located at the same place as the corresponding profile of the wrist watch case to be ground shown by hatched portions in FIGS. 1, 2 and 3. That is, a distance l from the head swing supporting shaft 6 to the surface to be ground of the wrist watch case 2 must be equal to a distance l' from the head swing supporting shaft 6 to the profiling surface of the profiling cam 9. That is, the condition that $l=l'$ must be satisfied.

Reference numeral 10 designates a profiling cam follower secured to a work table 24 mounted on the main body 25 and reciprocating therealong. The contact surface of the cam follower 10 with the profiling cam 9 must be in the same plane as the grinding surface of the grinding tool 1 and additionally the work shaft 4 must be in parallel with the profile cam shaft.

Reference numeral 11 designates a head swing angle control cam secured to the profile cam shaft 8; 12 a timing pulley secured to the profile cam shaft 8; 13 a timing pulley secured to the work shaft 4 and connected through a timing belt 14 and the timing pulley 12 to the profile cam shaft 8 so as to rotate the profile cam shaft 8 in synchronism with the work shaft 4; 15 a timing pulley secured to the work shaft 4; 16 a timing pulley secured to an output shaft of a driving motor 18 and connected through a timing belt 17 and the timing pulley 15 to the work shaft 4 so as to rotate it; and 19 a cam follower roller engaged with the head swing angle control cam 11 and rotatably supported by a cam follower shaft 20 secured to a follower holder 21 projected from the profile slide 23.

The profile slide 23 is mounted on the work table 24 so as to slide toward the profiling cam follower 10 and always biased in a direction shown by an arrow B by means of a compression spring 22. As a result, the profile cam 9 is always urged against the cam follower 10.

The work table 24 slidably mounted on the main body 25 is driven by a cylinder or the like (not shown) so as to be moved forwardly in a direction shown by an arrow A and to be moved backwardly. Reference numeral 26 designates a stopper secured to the main body 25 and provided with an adjustable screw **26*a* which can determine the final position of the work table 24** in its forward direction.

Figure 4:
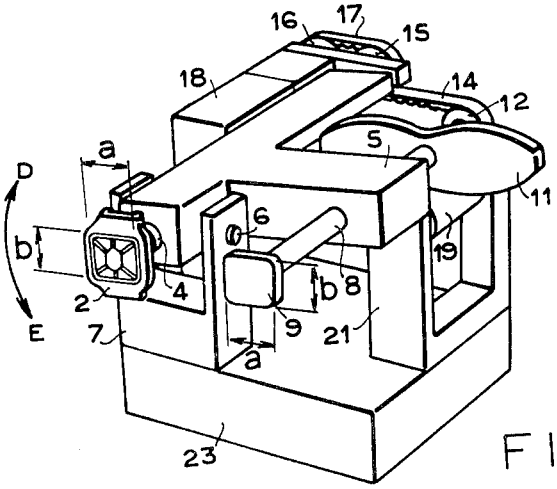
FIG. 4 is a perspective view of main parts of one embodiment of a profile grinding machine according to the invention.
Figure 5:
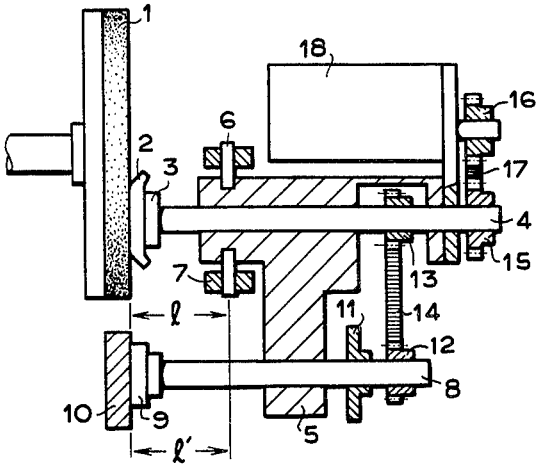
FIG. 5 is its plan view, partly shown in section.
Figure 6:
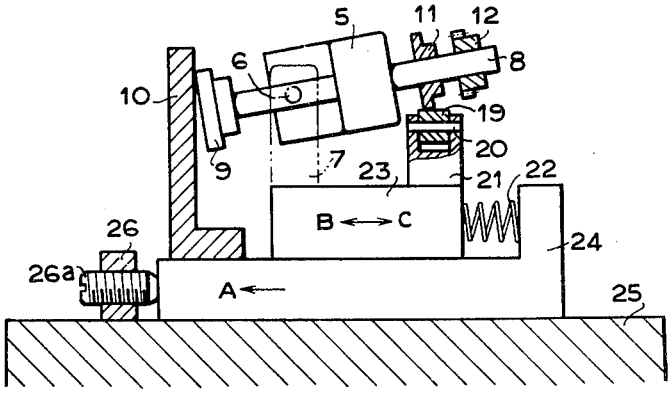
FIG. 6 is its front elevational view, partly shown in section.

In accordance with the invention, the article to be ground which is the wrist watch case 2 in the present embodiment and the profiling cam 9 are concerned with the head swing angle control cam 11 under the following condition. As shown in FIGS. 1 and 4, let the standard dimensions of the surface configuration to be ground of the wrist watch case 2 be a, b, then corresponding dimensions of the profiling cam 9 should also be made a, b as shown in FIG. 4. As shown in FIG. 2, the longitudinal upper peripheral edge surface of the wrist watch case 2 is inclined at an angle $\alpha$ with respect to the upper horizontal surface of the wrist watch case 2. As shown in FIG. 3, the transverse upper peripheral edge surface of the wrist watch case 2 is inclined at an angle $\beta$ with respect to the upper horizontal surface of the wrist watch case 2. If the inclined portion of the longitudinal upper peripheral edge surface of the wrist watch case 2 is urged against the grinding tool 1, the work shaft 4 is made inclined at the angle $\alpha$ and the depressed portion of the head swing angle control cam 11 makes contact with the cam follower 19. On the contrary, if the inclined portion of the transverse upper peripheral edge surface of the wrist watch case 2 is urged against the grinding tool 1, the work shaft 4 is made inclined at the angle $\beta$ and the lobe portion of the head swing angle control cam 11 makes contact with the cam follower 19.

The profile grinding machine constructed as above described will operate as follows.

In the first place, an electric supply source for the profile grinding machine is made ON, to rotate the grinding tool 1 such as the grindstone or the like. The article to be ground which is the wrist watch case 2 in the present embodiment is mounted on the chuck 3. An electric supply source for the cylinder for moving the work table 24 is also made ON to forwardly move the work table 24. At the same time, the driving motor 18 is rotated to rotate the work shaft 4 in synchronism with the profile cam shaft 8. In the meantime, the work table 24 is urged against the adjustable screw 26*a* of the stopper 26 and becomes stopped. In this case, the adjustable screw 26*a* is set to a proper position such that a suitable amount of grinding is effected to the wrist watch case 2, thereby starting the grinding operation. The resultant motion of the profiling cam 9 and head swing angle control cam 11 mounted on the profile cam shaft 8 causes the profile cam shaft 8 to effect the head swing movement in directions shown by arrows D–E while the profile cam shaft 8 together with the profile slide 23 reciprocate in directions shown by arrows B–C, thereby grinding the wrist watch case 2 into the desired configuration. After a given lapse of time determined by experience, the cylinder causes the work table 24 to move backwardly and at the same time the driving motor 18 is deenergized to stop its rotation, thereby completing the grinding operation.

As stated hereinbefore, the profile grinding machine according to the invention is capable of mechanically effecting its head swinging and position determining movements and hence capable of grinding an article to be ground such as a wrist watch case or the like into a precise configuration well matched with the requirement. In addition, the profile grinding machine according to the invention can simply obtain a uniform article which is higher in quality than conventional manual grinding operation or the like, thereby considerably improving the grinding efficiency.

What is claimed is:

1. A profile grinding machine comprising:

(a) a main body;

(b) a work table reciprocating on said main body;

(c) a profile slide slidably mounted on said work table and biased in a direction in parallel with the forward movement of said work table;

(d) a profile cam shaft having an axis provided in said profile slide and extending in parallel with the movable direction of said work table;

(e) a work shaft provided at its one end with a chuck for supporting an article to be ground and adapted to be rotated through a transmission mechanism in synchronism with said profile cam shaft;

(f) a head swing supporting shaft mechanism common to both said profile cam shaft and said work shaft and imparting the head swing movement of said profile cam shaft to said work shaft in synchronism with said profile cam shaft;

(g) a cam mechanism secured to said profile cam shaft provided in said profile slide and for controlling the head swing angle of said head swing supporting shaft mechanism; and (h) a grinding tool rotatably mounted on said main body and opposed to said chuck secured to said work shaft.

2. The profile grinding machine according to claim 1, wherein said cam mechanism is composed of a head swing angle control cam secured to said profile cam shaft and a cam follower secured to said profile slide.

3. The profile grinding machine according to claim 1, wherein said article to be ground is a wrist watch case.

4. The profile grinding machine according to claim 1, wherein the surface to be ground of said article to be ground and the profiling surface of said profile cam are aligned on the same plane equally distant apart from said supporting shaft of said head swing supporting shaft mechanism and both said surfaces are traced on the same movement loci, respectively.

5. The profile grinding machine according to claim 1, wherein said head swing supporting shaft mechanism is composed of a head swing supporting shaft around which is effected said head swing movement of said work shaft and a head swing supporting shaft holder provided on said profile slide and for supporting said head swing supporting shaft, and a supporting member supported on said head swing supporting shaft holder and moved by said head swing angle control cam.

6. The profile grinding machine according to claim 1, wherein said transmission mechanism is composed of timing pulleys secured to said profile cam shaft and said work shaft, respectively.

7. The profile grinding machine according to claim 1, wherein said main body is provided in front of said work table with a stopper mechanism for determining the forwardly moved position of said work table.

* * * * *

UNITED STATES PATENT OFFICE

CERTIFICATE OF CORRECTION

Patent No. 4,167,836 Dated September 18, 1979

Inventor(s) Tadao Takishima

It is certified that error appears in the above-identified patent and that said Letters Patent are hereby corrected as shown below:

In Column 2, line 23, delete the word "place" and substitute the word "plane".

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*